US010046931B2

(12) United States Patent
Shima

(10) Patent No.: US 10,046,931 B2
(45) Date of Patent: Aug. 14, 2018

(54) SHEET CONVEYING APPARATUS, IMAGE FORMING APPARATUS, AND IMAGE READING APPARATUS

(71) Applicant: CANON KABUSHIKI KAISHA, Tokyo (JP)

(72) Inventor: Toshihide Shima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/613,536

(22) Filed: Jun. 5, 2017

(65) Prior Publication Data

US 2017/0355542 A1 Dec. 14, 2017

(30) Foreign Application Priority Data

Jun. 10, 2016 (JP) ..... 2016-115960
Mar. 9, 2017 (JP) ..... 2017-044610

(51) Int. Cl.
*B65H 5/06* (2006.01)
*G03G 21/16* (2006.01)

(52) U.S. Cl.
CPC ..... *B65H 5/062* (2013.01); *G03G 21/1638* (2013.01); *B65H 2402/441* (2013.01); *B65H 2404/142* (2013.01)

(58) Field of Classification Search
CPC ..... B65H 5/062; B65H 2402/411; B65H 2404/142; G03G 21/1638
See application file for complete search history.

(56) References Cited

U.S. PATENT DOCUMENTS 8,849,158 B2 * 9/2014 Kamano ..... G03G 15/161 399/121
9,500,999 B2 * 11/2016 Koshida ..... G03G 15/1605
9,718,633 B2 * 8/2017 Osada ..... B65H 5/062
9,731,918 B2 * 8/2017 Lee ..... B65H 5/068
2007/0091157 A1 * 4/2007 Ito ..... B41J 11/006 347/104
2010/0278557 A1 * 11/2010 Somemiya ..... G03G 21/1638 399/124

(Continued)

FOREIGN PATENT DOCUMENTS

JP 2013228655 A 11/2013
JP 2013231807 A 11/2013
JP 2015069066 A 4/2015

*Primary Examiner* — Patrick Cicchino
(74) *Attorney, Agent, or Firm* — Fitzpatrick, Cella, Harper & Scinto

(57) ABSTRACT

A sheet conveying apparatus, includes:

a first roller;

an opening-closing member that is movable between an open position and a close position;

a second roller;

an urging member;

a restraint member switching between a restraint state in which a rotation shaft of the second roller is restrained and a release state in which the rotation shaft is released from the restraint, by being moved, wherein, during the movement of the opening-closing member from the open position to the close position, the restraint member keeps the rotation shaft in the restraint state; and a releasing member that is moved by driving force from the drive source when the opening-closing member is in the close position and the rotation shaft is in the restraint state, the releasing member switching the rotation shaft to the release state by moving the restraint member as being engaged with the restraint member.

10 Claims, 9 Drawing Sheets

(56) References Cited

U.S. PATENT DOCUMENTS

| | | | | |
|---|---|---|---|---|
| 2013/0164066 | A1* | 6/2013 | Nakamura | G03G 21/1638 399/405 |
| 2014/0147183 | A1* | 5/2014 | Koshida | B65H 29/52 399/388 |
| 2014/0341611 | A1* | 11/2014 | Asakawa | G03G 21/1633 399/124 |

* cited by examiner

SHEET CONVEYING APPARATUS, IMAGE FORMING APPARATUS, AND IMAGE READING APPARATUS

BACKGROUND OF THE INVENTION

Field of the Invention

The present invention relates to a sheet conveying apparatus that conveys a sheet. The present invention also relates to an image forming apparatus provided with the sheet conveying apparatus, such as an electrophotographic copying machine, an electrophotographic printer, or an ink jet printer, or to an image reading apparatus provided with the sheet conveying apparatus, such as an image scanner.

Description of the Related Art

An image forming apparatus such as a copying machine is provided with a sheet conveying portion (sheet conveying apparatus) including a pair of rollers that nips and conveys a sheet serving as a recording medium. Also, a configuration has been known in which a door (opening-closing member) that is openable/closable with respect to an apparatus body is provided and the door is opened/closed in a process for a sheet jam (hereinafter referred to as a jam) caused in the sheet conveying portion. Examples of the configuration of the door include the following: a door that serves as an exterior on the lateral surface of an apparatus and is opened/closed about a lower part thereof; and a door that slides in the horizontal direction (almost parallel to the surface on which the apparatus is installed).

There has also been known a configuration in which, to facilitate a jam recovery, a pair of rollers in the sheet conveying portion is separated from each other so that a sheet conveyance path can be opened (nip of a sheet can be released). Notably, it is desirable that, in opening-closing the door, the door is opened/closed such that one of the pair of rollers is translated relative to the other roller in the roller axial direction to reduce damage to the pair of rollers which is separated from each other.

Here, the pair of rollers nips and conveys a sheet, so that the rollers exert appropriate pressure on each other. The pressure is set to be about 1 to 5 kgf for a pair of registration rollers, and about 3 to 8 kgf for a pair of transfer rollers. Therefore, in closing the door, loads are applied in response to reaction force by the pressure of each roller.

In view of this, Japanese Patent Laid-Open No. 2013-231807 discloses a configuration of including a drive device for allowing one of a pair of rollers, which nips and conveys a sheet, to be in contact with or separated from the other, wherein a cover can be opened/closed with the one roller being separated from the other by the drive device. Thus, loads applied upon closing the cover can be reduced.

However, in the configuration disclosed in Japanese Patent Laid-Open No. 2013-231807, the rollers are separated from each other by the drive device, so that the configuration needs a drive source additionally provided or a mechanism for switching an input from an existing drive source. This increases component cost.

SUMMARY OF THE INVENTION

The representative configuration of a sheet conveying apparatus according to the present invention is a sheet conveying apparatus including: a first roller that is provided to an apparatus body and rotates by receiving driving force from a drive source; an opening-closing member that is provided to the apparatus body and is movable between an open position where a jam recovery of a sheet is enabled and a close position where sheet conveyance is performed; a second roller that is provided to the opening-closing member, the second roller being urged toward the first roller to convey the sheet with the rotation of the first roller, when the opening-closing member is in the close position; urging member that is provided on the opening-closing member at a position between the second roller and the opening-closing member, the urging member applying a force to the second roller toward the first roller when the opening-closing member is in the close position; a restraint member that is provided to the opening-closing member, the restraint member being brought into contact with a rotation shaft of the second roller and restrain the rotation shaft relative to the opening-closing member with the urging member being compressed when being moved, the restraint member switching between a restraint state in which the rotation shaft is restrained and a release state in which the rotation shaft is released from the restraint, by being moved, wherein, when the opening-closing member is in the close position and the rotation shaft is in the release state, the restraint member switches the rotation shaft to the restraint state from the release state during the movement of the opening-closing member from the close position to the open position, and keeps the rotation shaft in the restraint state until the opening-closing member reaches the open position, and during the movement of the opening-closing member from the open position to the close position, the restraint member keeps the rotation shaft in the restraint state; and a releasing member that is moved by driving force from the drive source when the opening-closing member is in the close position and the rotation shaft is in the restraint state, the releasing member switching the rotation shaft to the release state by moving the restraint member as being engaged with the restraint member.

Further features of the present invention will become apparent from the following description of exemplary embodiments with reference to the attached drawings.

DESCRIPTION OF THE EMBODIMENTS (First Embodiment)

<Image Forming Apparatus>

Hereinafter, the overall configuration of an image forming apparatus A provided with a sheet conveying apparatus according to a first embodiment of the present invention will firstly be described, together with the operation for forming an image, with reference to the drawings. It should be recognized that the dimension, material, shape, relative arrangement and the like of the components described herein are not intended to limit the scope of the invention unless specifically stated in particular.

The image forming apparatus A is a color image forming apparatus of an intermediate transfer tandem system that primarily transfers toner of four colors which are yellow Y, magenta M, cyan C, and black K onto an intermediate transfer belt, and then, secondarily transfers the toner onto a sheet serving as a recording medium, to thereby form an image.

Figure 1:
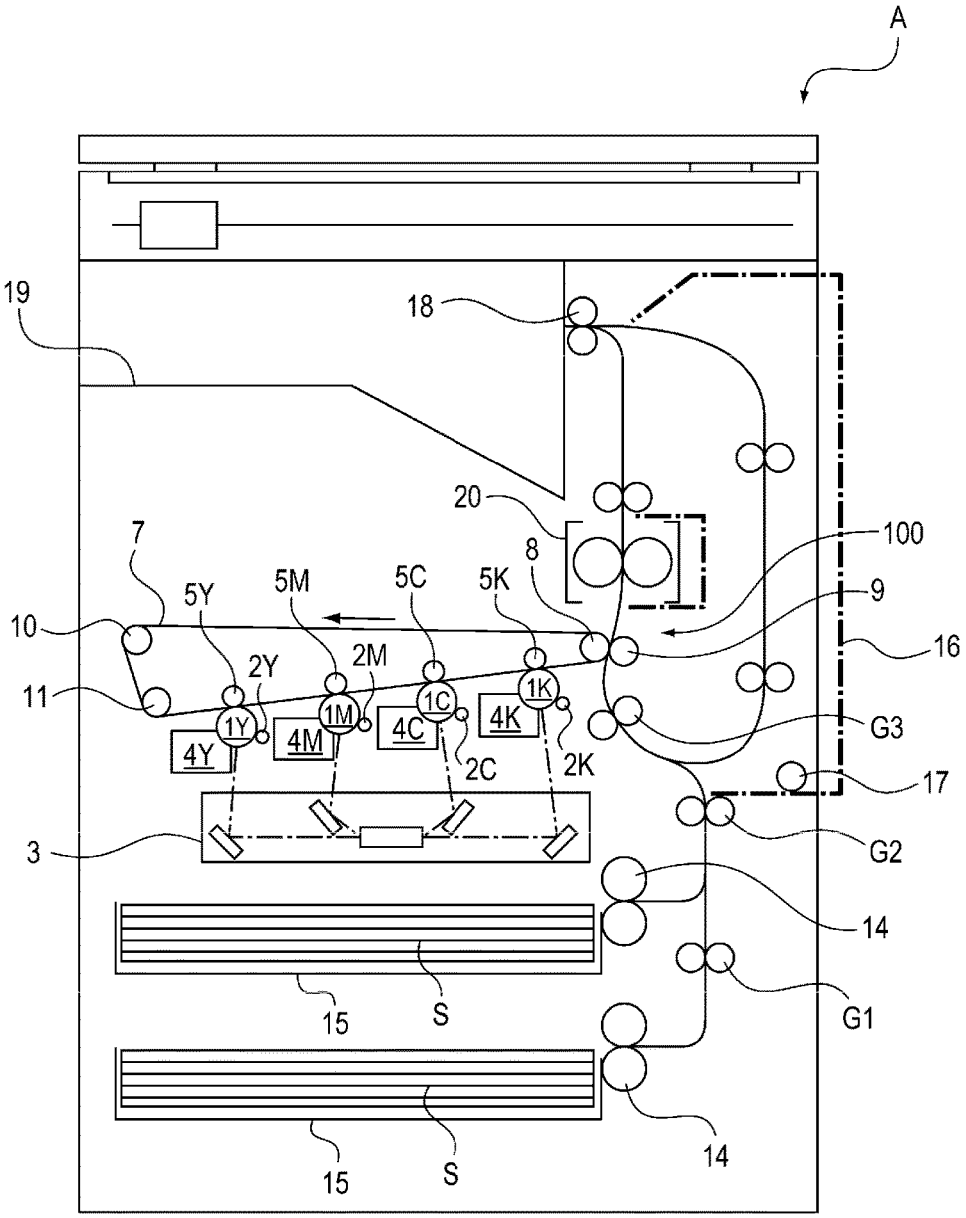
FIG. 1 is a schematic sectional view of an image forming apparatus.

As illustrated in FIG. 1, the image forming apparatus A has an image forming portion for transferring a toner image onto a sheet, a sheet feeding portion for feeding a sheet to the image forming portion, and a fixing portion for fixing the toner image onto the sheet.

As illustrated in FIG. 1, the image forming portion includes a photosensitive drum 1 (1Y, 1M, 1C, 1K) which is rotatably provided, and a charging roller 2 (2Y, 2M, 2C, 2K) for charging the photosensitive drum 1. The image forming portion also includes an intermediate transfer unit, a laser scanner unit 3, a development device 4 (4Y, 4M, 4C, 4K), and the like.

The intermediate transfer unit includes a primary transfer roller 5 (5Y, 5M, 5C, 5K), a secondary transfer roller 9 (second roller, transfer member), a secondary transfer counter roller 8 (first roller), and an intermediate transfer belt 7 (intermediate transfer member, image bearing member). The secondary transfer counter roller 8 rotates when driving force is inputted thereto from an unillustrated drive source, such as a motor, from an unillustrated drive input portion mounted on an end of a rotation shaft thereof. The intermediate transfer belt 7 is an endless cylindrical belt, and is stretched by the secondary transfer counter roller 8, a first stretching roller 10, and a second stretching roller 11 so as to be supported in a freely rotatable manner. The intermediate transfer belt 7 and the secondary transfer roller 9 rotate following the rotation of the secondary transfer counter roller 8.

A sheet is conveyed while being nipped by the secondary transfer counter roller 8 and the secondary transfer roller 9, and as stated below, a toner image carried on the intermediate transfer belt 7 is transferred onto the sheet. That is, a secondary transfer portion 100 includes the secondary transfer counter roller 8 and the secondary transfer roller 9. This secondary transfer portion 100 functions as a sheet conveying apparatus that nips and conveys a sheet. The secondary transfer portion 100 is also a portion of the image forming apparatus A. Therefore, in the present embodiment, an apparatus body of the sheet conveying apparatus means a body of the image forming apparatus A.

In the present embodiment, the secondary transfer counter roller 8 has a metal core made of iron as a core, and an elastic layer made of a semiconductive rubber containing EPDM as a principal component. The secondary transfer roller 9 has a metal core made of iron as a core, and an elastic layer made of a semiconductive sponge containing NBR or epichlorohydrin rubber as a principal component.

In addition, a door 16 as an opening-closing member is provided on the side surface of the body of the image forming apparatus A. The door 16 is configured to be openable/closable (openable) relative to the body of the image forming apparatus A (the apparatus body of the sheet conveying apparatus) by rotating around a rotation shaft 17. The door 16 is also configured such that an opening angle relative to the apparatus body can be regulated by a stopper member (not illustrated). To remove a sheet in the image forming apparatus A for the jam recovery or to provide maintenance for the image forming portion, the door 16 is opened to enable these processes.

In addition, the secondary transfer roller 9 is supported by the door 16, and when the door 16 is opened, the secondary transfer roller 9 is separated from the intermediate transfer belt 7 and the secondary transfer counter roller 8. Thus, when jamming occurs or under other situations, the sheet conveyance path is opened (nip of a sheet is released), and the sheet nipped by the secondary transfer portion 100 can easily be removed. Specifically, the door 16 is configured to be movable between an open position where the door 16 is opened relative to the body of the image forming apparatus A and a close position where the door 16 is closed. When the door 16 is in the open position, a jam recovery for a sheet is enabled, and when the door 16 is in the close position, a sheet is conveyed by the secondary transfer portion 100.

In image formation, when an unillustrated CPU issues a print signal, a sheet S stacked and stored on a sheet stacking portion 15 is fed to the sheet conveyance path by a feed roller 14. The fed sheet is conveyed to an unillustrated sheet skew feeding correction apparatus through a conveying roller G (G1, G2), and after the skew feeding is corrected, the sheet is conveyed to the image forming portion by a conveying roller G3.

On the other hand, in the image forming portion, the surface of the photosensitive drum 1 is firstly charged by the charging roller 2. Then, the surface of the photosensitive drum 1 is irradiated with laser light emitted from the laser scanner unit 3 on the basis of image information transmitted from an unillustrated external connection cable, whereby an electrostatic latent image is formed on the surface of the photosensitive drum 1. The electrostatic latent image is developed by depositing toner thereon by the development device 4, and thus, a toner image (developer image) is formed on the photosensitive drum 1.

The toner image formed on the photosensitive drum 1 is primarily transferred respectively on the intermediate transfer belt 7 through application of primary transfer bias to the primary transfer roller 5 at a primary transfer portion including the photosensitive drum 1 and the primary transfer roller 5.

The intermediate transfer belt 7 rotates with the rotation of the secondary transfer counter roller 8, by which the toner image reaches the secondary transfer portion 100 located downstream with respect to the rotation direction. When a secondary transfer bias is applied to the secondary transfer roller 9 at the secondary transfer portion 100, the toner image is transferred onto the sheet.

The sheet having the toner image transferred thereon is conveyed to a fixing device 20 where heat and pressure are applied thereto to fix the toner image on the sheet. Thereafter, the sheet is discharged onto a discharge tray 19 disposed in the image forming apparatus A through a discharge roller 18.

If an image is to be formed on both surfaces of the sheet, the leading end of the sheet is temporarily placed on the discharge tray 19, and after the trailing end of the sheet S passes an unillustrated branch point, the sheet is switched back and conveyed to an unillustrated reverse conveying apparatus. Then, the sheet is conveyed to the image forming portion in the reversed state, and an image is formed on the back surface in the manner similar to the image formation for the front surface.

<Sheet Conveying Apparatus>

Figure 2:
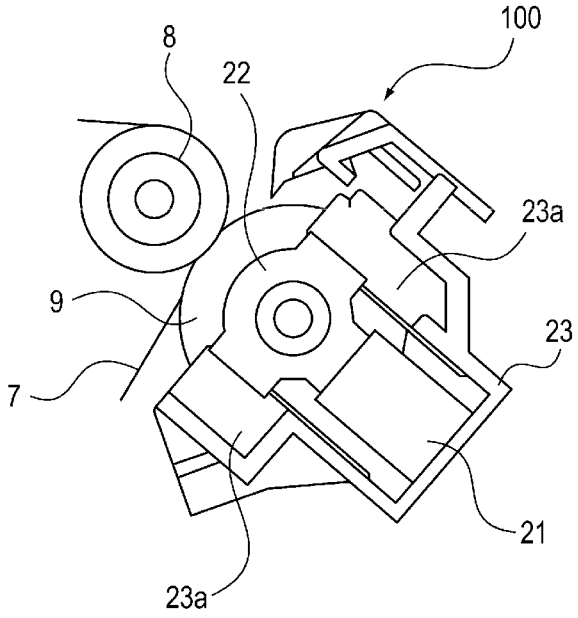
FIG. 2 is a schematic sectional view of a secondary transfer portion.

Next, the configuration of the secondary transfer portion 100 serving as the sheet conveying apparatus will be described in detail. FIG. 2 is a sectional view illustrating the configuration of the secondary transfer portion 100, and FIG. 3A is a side view.

Figure 3A:
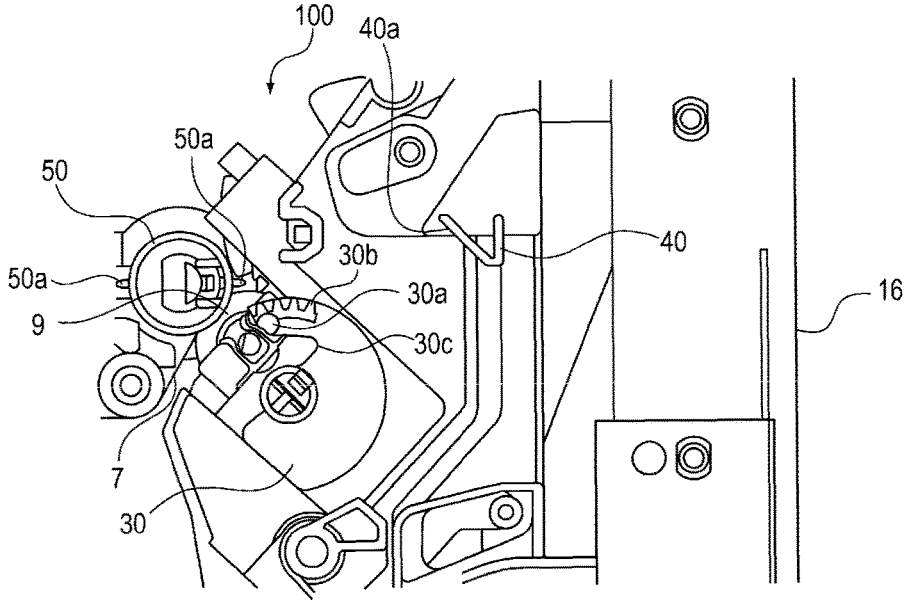
FIGS. 3A and 3B are side views of the secondary transfer portion.

As illustrated in FIGS. 2 and 3A, the secondary transfer portion 100 has the secondary transfer counter roller 8 and the secondary transfer roller 9 that is provided to face the secondary transfer counter roller 8, the secondary transfer roller 9 nipping and conveying a sheet in conjunction with the secondary transfer counter roller 8. The secondary transfer portion 100 also includes a transfer spring 21 (urging member), a pressure bearing 22, a transfer conveyance guide 23, a restriction rib 23*a*, a separation cam 30 (restraint member, cam member), a restriction member 40, a separation releasing member 50 (releasing member), etc. Note that, as described above, the secondary transfer roller 9 is provided to the door 16 side. In addition, the transfer spring 21, the pressure bearing 22, the transfer conveyance guide 23, the restriction rib 23*a*, and the separation cam 30 are also provided to the door 16 side. The transfer spring 21 is provided between the door 16 and the secondary transfer roller 9 on the door 16. The separation cam 30 is axially supported to be rotatable relative to a camshaft mounted to the door 16.

The pressure bearing 22 is mounted on the end of the rotation shaft of the secondary transfer roller 9 to axially support the secondary transfer roller 9 in a freely rotatable manner. The transfer spring 21 is installed with the transfer conveyance guide 23 being a seat surface. When the door 16 is in the close position, the transfer spring 21 applies a force to the secondary transfer roller 9 toward the secondary transfer counter roller 8 through the pressure bearing 22. Thus, contact pressure of the secondary transfer roller 9 to the intermediate transfer belt 7 and the secondary transfer counter roller 8 is generated.

The restriction rib 23*a* is engaged with the pressure bearing 22 to restrict the direction of movement of the pressure bearing 22. Thus, the secondary transfer roller 9 is movable only in the direction of being urged by the transfer spring 21 with respect to the transfer conveyance guide 23, and the movement of the secondary transfer roller 9 in other directions is restricted.

According to the configuration described above, the secondary transfer counter roller 8 is urged toward the secondary transfer roller 9 through the intermediate transfer belt 7. Therefore, the secondary transfer roller 9 is driven to rotate by friction force of the intermediate transfer belt 7 that rotates by the rotation of the secondary transfer counter roller 8, and the toner on the intermediate transfer belt 7 can be transferred onto the sheet.

It is to be noted that, in the present embodiment, two transfer springs 21 respectively apply a force to the pressure bearings 22 mounted at both ends of the rotation shaft of the secondary transfer roller 9. A spring pressure for each transfer spring 21 is set to be 3 kgf. Therefore, the secondary transfer roller 9 presses the secondary transfer counter roller 8 by 6 kgf in total.

In addition, at the secondary transfer portion 100, the separation releasing member 50 is mounted on the end of the rotation shaft of the secondary transfer counter roller 8, and rotates in synchronization with the rotation of the secondary transfer counter roller 8. Further, the separation releasing member 50 is provided with a release protrusion 50*a* (protrusion).

<Movement of Second Roller>

Next, the movement of the secondary transfer roller 9 serving as a second roller will be described. As stated previously, the secondary transfer roller 9 is separated from the intermediate transfer belt 7 and the secondary transfer counter roller 8 with the operation of opening the door 16. In addition, as described below, in the state in which the door 16 is closed, the secondary transfer roller 9 is in contact with the secondary transfer counter roller 8 through the intermediate transfer belt 7, and apply a force to the secondary transfer counter roller 8 by urging force of the transfer spring 21. Firstly, the movement of the secondary transfer roller 9 will be described below.

Figure 3B:
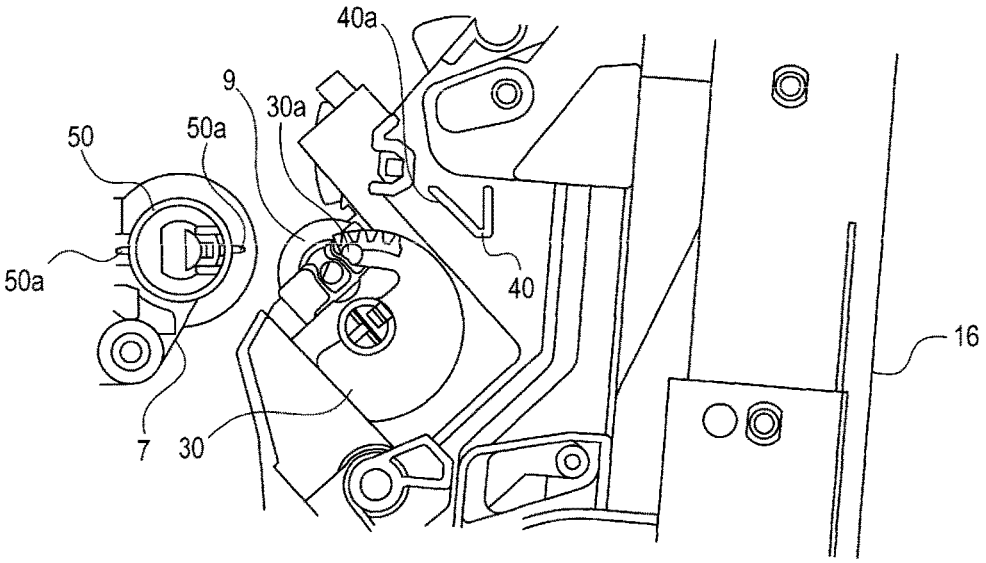

At first, when the door 16 is opened, the secondary transfer roller 9 supported by the door 16 is changed from the state (FIG. 3A) of being in contact with the secondary transfer counter roller 8 through the intermediate transfer belt 7 to the state (FIG. 3B) of being separated therefrom.

Figure 4A:
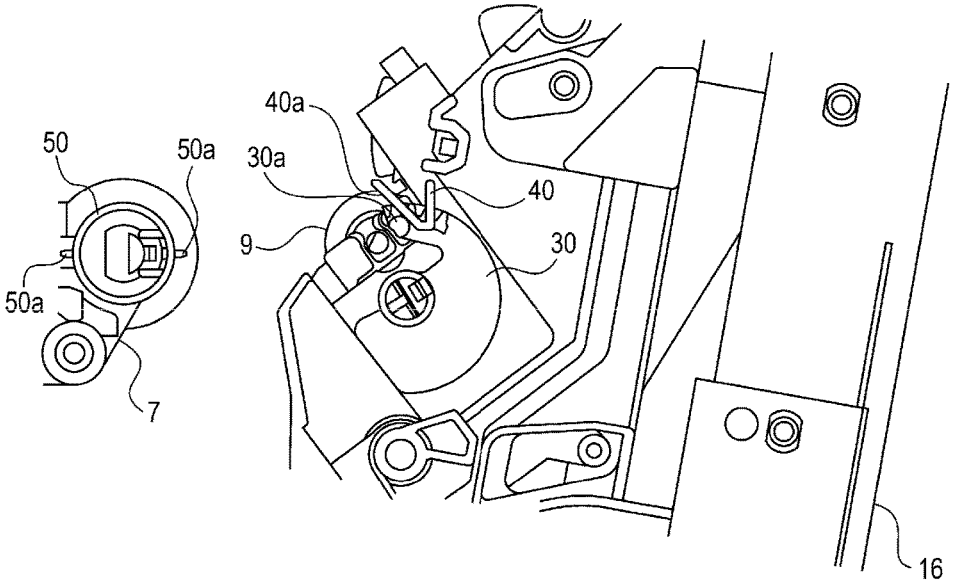
FIGS. 4A and 4B are side views of the secondary transfer portion when a secondary transfer roller moves.

When the door 16 is then further opened, a boss 30*a* of the separation cam 30 abuts on an inclined portion 40*a* of the restriction member 40 (FIG. 4A). From the state illustrated in FIG. 3A to the state illustrated in FIG. 4A, the angle between the body of the image forming apparatus A and the door 16 is changed from 0° to 10°.

Notably, there is an interval before the separation cam 30 and the restriction member 40 abut on each other to utilize a force of the door 16 trying to move in the opening direction due to the own weight of the door 16. Specifically, in the process of opening the door 16, the opening operation is switched to an operation in which the door 16 is opened by the own weight of the door 16, when the center of gravity of the door 16 moves beyond the rotation center. By means of utilizing the force of the door 16 trying to open by the own weight of the door 16 as described above, the power of the user to operate the door 16 can be reduced. That is, the power to operate the door 16 can be reduced by disposing the restriction member 40 at the downstream side from the rotation center with respect to the rotation direction of the door 16.

Figure 4B:
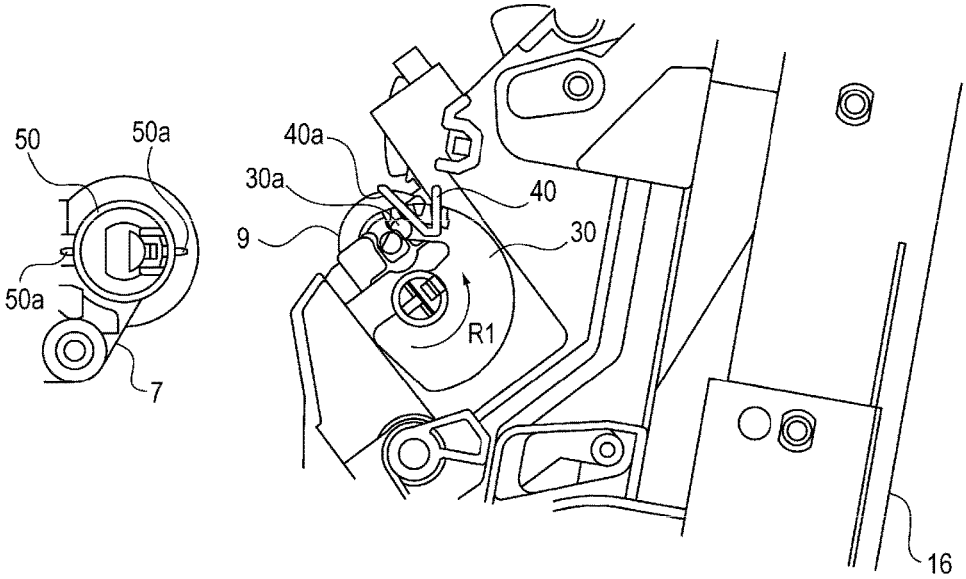

When the door 16 is then further opened, the boss 30*a* moves downward while sliding along the inclined portion 40*a*. At that time, the boss 30*a* receives reaction force from the inclined portion 40*a*. Due to this reaction force, the separation cam 30 starts to rotate in a direction of an arrow R1 (FIG. 4B).

Figure 5A:
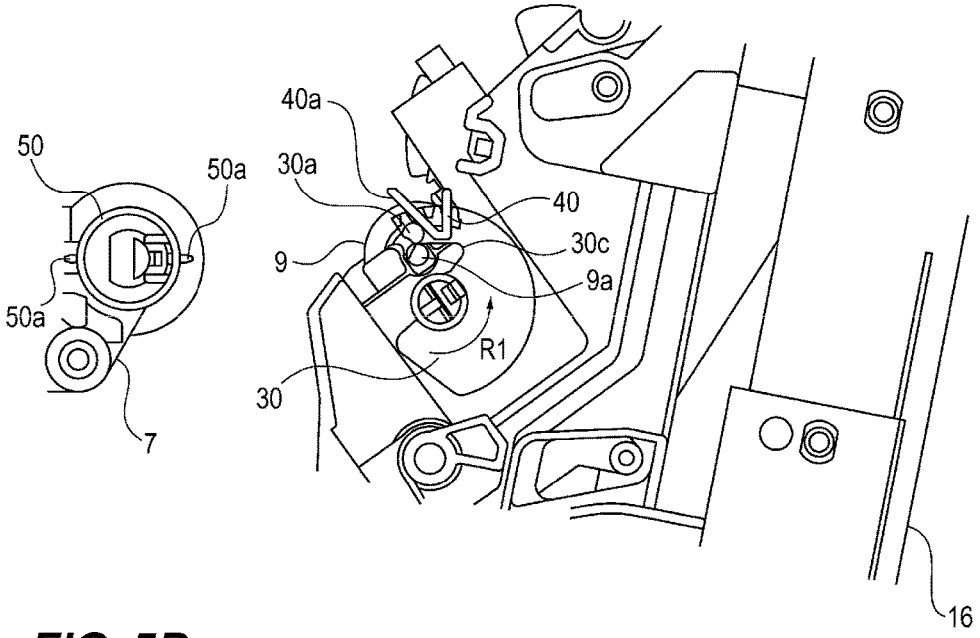
FIGS. 5A and 5B are side views of the secondary transfer portion when the secondary transfer roller moves.
Figure 5B:
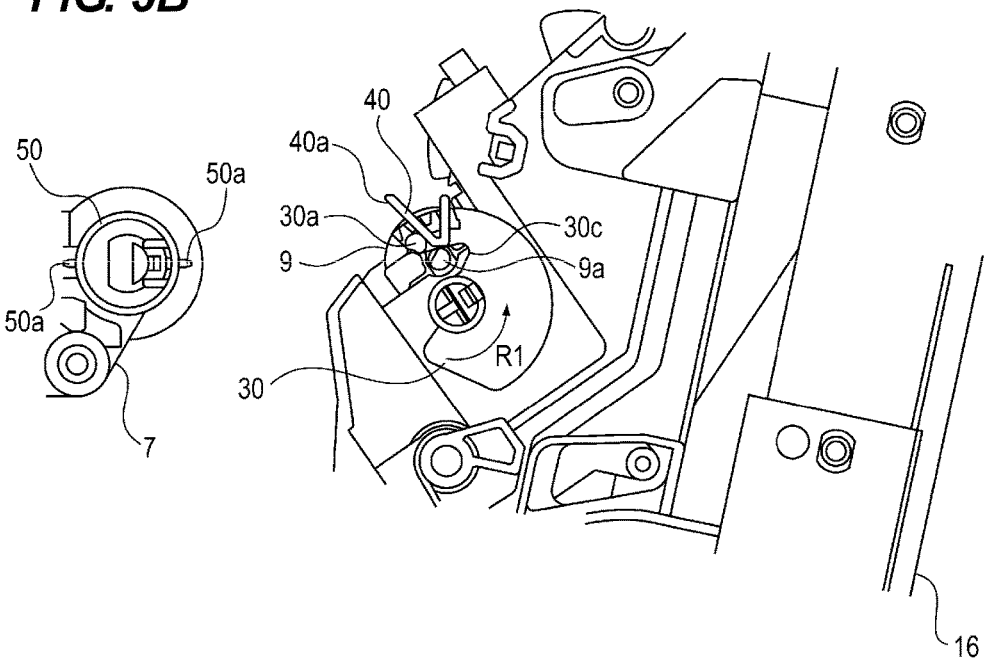
Figure 6A:
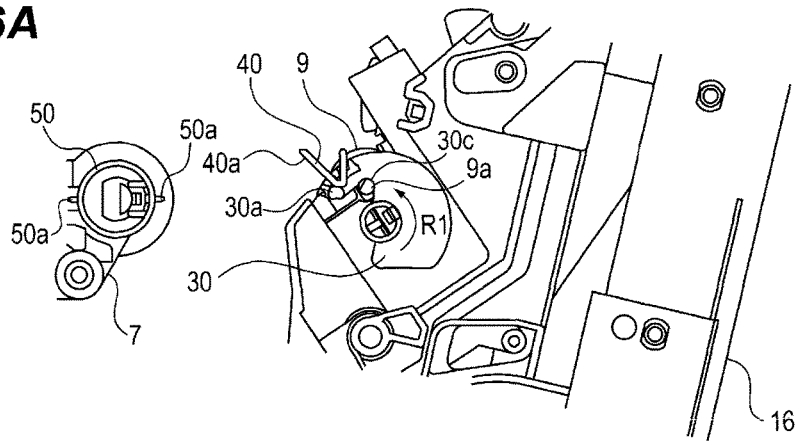
FIGS. 6A to 6C are side views of the secondary transfer portion when the secondary transfer roller moves.

Then, as the door 16 is opened, the boss 30*a* moves downward along the inclined portion 40*a*, and the separation cam 30 rotates in the direction of the arrow R1 (FIGS. 5A and 5B). In addition, with the rotation of the separation cam 30, the rotation shaft 9*a* of the secondary transfer roller 9 moves to a roller restraint portion 30*c* (restraint portion) along the cam shape, with compressing the transfer spring 21 (FIGS. 5A, 5B, and 6A).

Figure 6B:
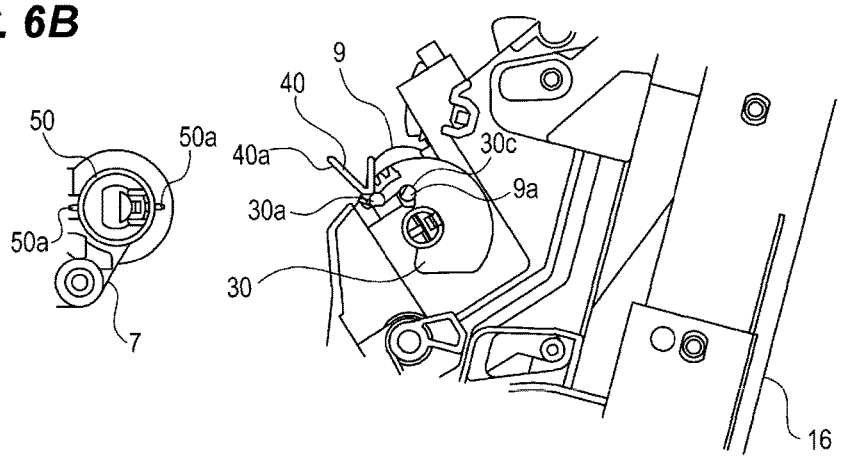
Figure 6C:
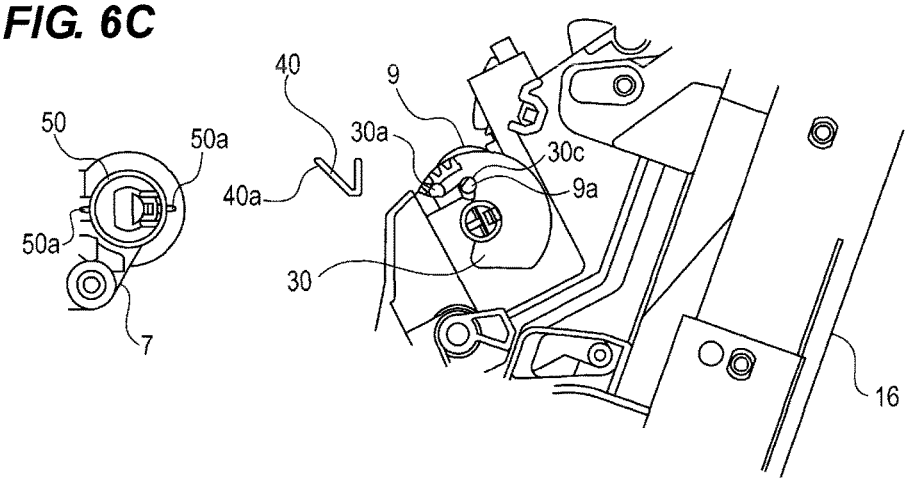

Then, when the boss 30*a* completely goes beyond the inclined portion 40*a* (FIG. 6B) and the door 16 is opened to a limit position (FIG. 6C), the separation cam 30 goes beyond the restriction member 40, and the rotation shaft 9*a* of the secondary transfer roller 9 is kept in a restraint state of being restrained by the roller restraint portion 30*c*.

Next, an operation for switching again the rotation shaft 9*a* of the secondary transfer roller 9 to a release state from the restraint state will be described.

Figure 7:
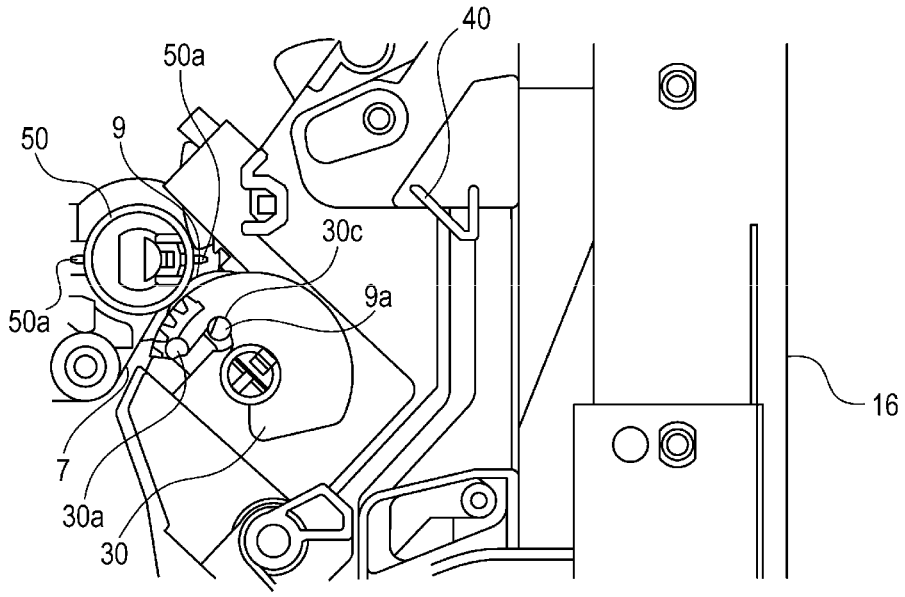
FIG. 7 is a side view of the secondary transfer portion immediately after a door is closed.

FIG. 7 is a side view illustrating the state of the secondary transfer portion 100 just after the door 16 is closed. As illustrated in FIG. 7, at that time, the rotation shaft 9*a* of the secondary transfer roller 9 is in the restraint state of being restrained with the transfer spring 21 being compressed by the roller restraint portion 30*c* of the separation cam 30, so that the secondary transfer roller 9 is separated from the intermediate transfer belt 7 without being in contact therewith.

Figure 8:
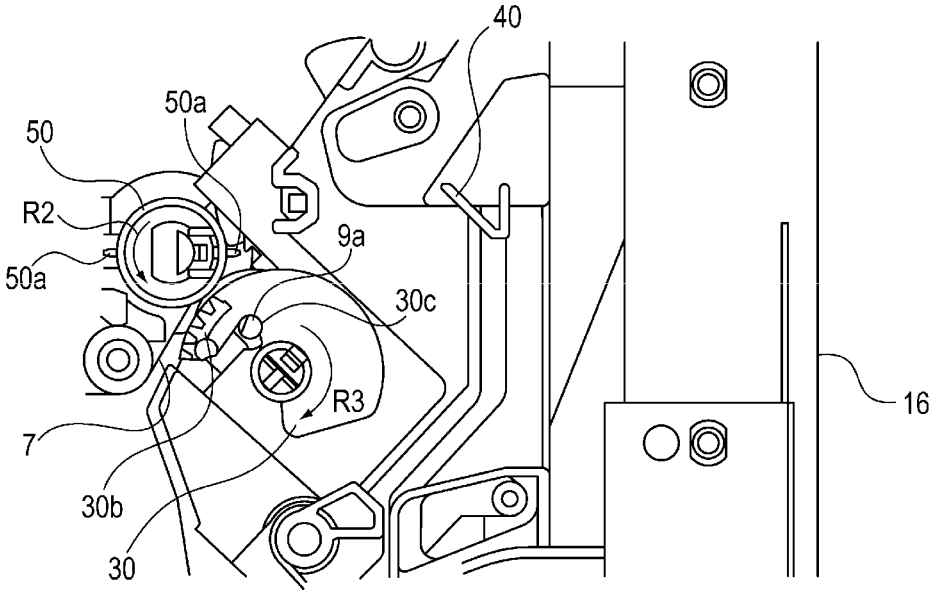
FIG. 8 is a side view of the secondary transfer portion when the secondary transfer roller moves.

FIG. 8 is a side view illustrating the state of the secondary transfer portion 100 when the body of the image forming apparatus A starts operating after the door 16 is closed. As illustrated in FIG. 8, when the body of the image forming apparatus A starts operating, the secondary transfer counter roller 8 to which driving force is inputted from the drive source rotates in a direction of an arrow R2, and the separation releasing member 50 rotates in the direction of the arrow R2 in synchronization with the rotation of the secondary transfer counter roller 8. Thus, the release protrusion 50*a* is engaged with the gear portion 30*b* of the separation cam 30.

Thereafter, with the rotation of the secondary transfer counter roller 8 in the direction of the arrow R2, the separation cam 30 that receives rotation force by the engagement between the release protrusion 50*a* and the gear portion 30*b* rotates in a direction of an arrow R3. That is, the release protrusion 50*a* and the gear portion 30*b* constitute a drive transmission portion for transmitting the driving force received by the secondary transfer counter roller 8 to the separation cam 30, and the separation cam 30 rotates by the rotation of the secondary transfer counter roller 8. When the separation cam 30 rotates to a predetermined position, the engagement between the roller restraint portion 30*c* of the separation cam 30 and the secondary transfer roller 9 is released, and the rotation shaft 9*a* is switched to the release state. Thus, the secondary transfer roller 9 applies a force to the secondary transfer counter roller 8 through the intermediate transfer belt 7 due to urging force of the transfer spring 21.

Specifically, when the door 16 is in the close position and the rotation shaft 9*a* of the secondary transfer roller 9 is in the release state, the separation cam 30 switches the rotation shaft 9*a* from the release state to the restraint state during the movement of the door 16 from the close position to the open position, and keeps the rotation shaft 9*a* in the restraint state until the door reaches the open position. In addition, the separation cam 30 keeps the rotation shaft 9*a* in the restraint state during the movement of the door 16 from the open position to the close position. Then, when the door 16 is in the close position, the separation cam 30 rotates by the engagement between the release protrusion 50*a* and the gear portion 30*b* due to the rotation of the separation releasing member 50, thereby switching the rotation shaft 9*a* to the release state from the restraint state.

As described above, when the door 16 is closed, the secondary transfer roller 9 is kept in the restraint state, whereby the door 16 can be closed without receiving reaction force by the transfer spring 21. In addition, due to the configuration in which the secondary transfer roller 9 is switched to the release state from the restraint state by the rotation of the secondary transfer counter roller 8 with the door 16 being closed, the secondary transfer roller 9 can be urged toward the secondary transfer counter roller 8 through the intermediate transfer belt 7 before the secondary transfer is started. Therefore, the load upon closing the door 16 can be reduced with a simple configuration without separately providing a mechanism for switching a drive source or an input from a drive source, whereby operability of the user can be improved.

Note that the separation cam 30 is disposed on the position where the separation cam 30 is not in contact with the secondary transfer roller 9 during the image formation or sheet conveyance. This is to prevent the spring pressure from the transfer spring 21 from dispersing due to the contact with the secondary transfer roller 9.

Figure 9:
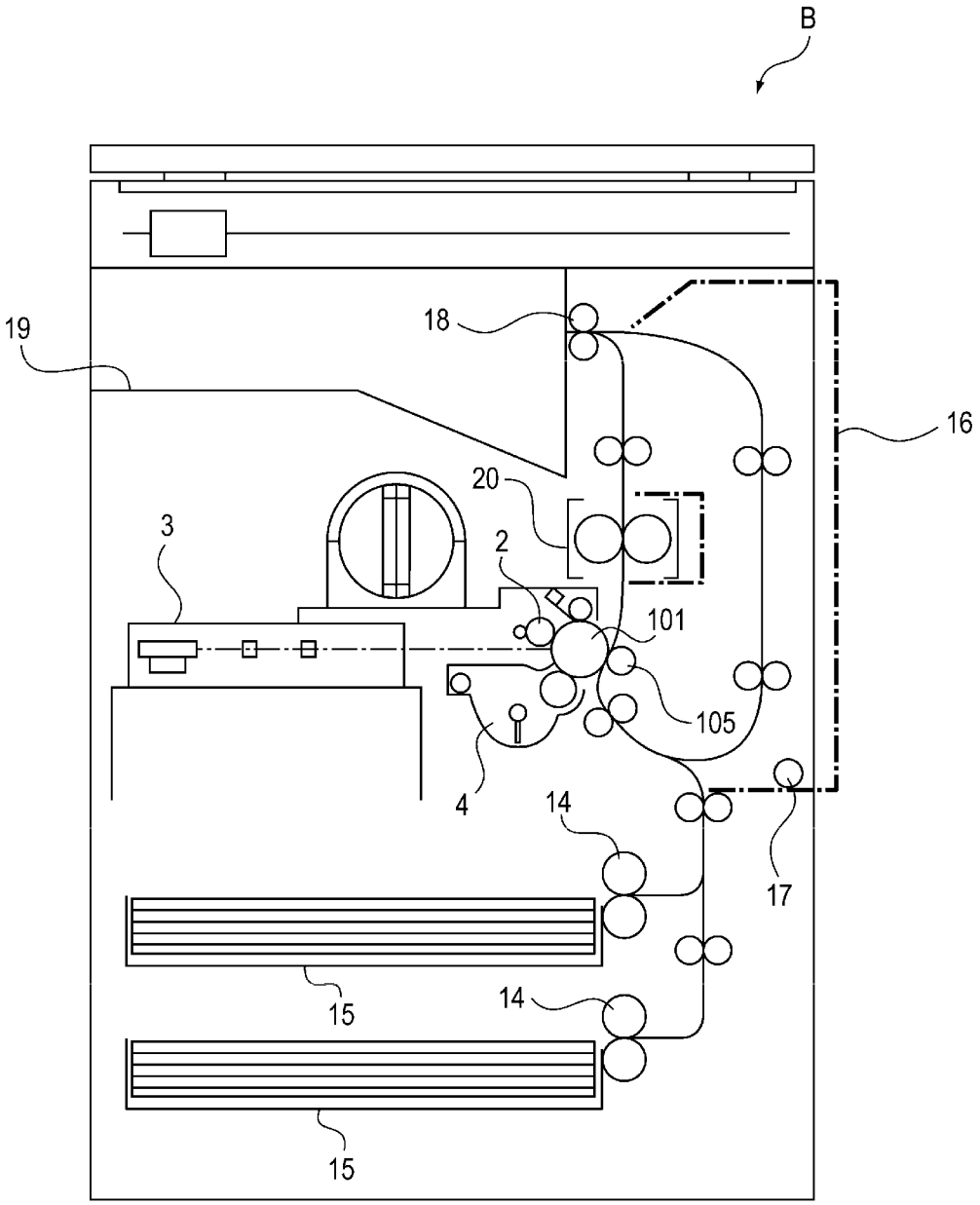
FIG. 9 is a schematic sectional view of another image forming apparatus.

In addition, while the present embodiment describes, as one example, the image forming apparatus A of an intermediate transfer system as an apparatus provided with a sheet conveying apparatus, the present invention is not limited thereto. For example, the present invention is applicable to an image forming apparatus B of a direct transfer system illustrated in FIG. 9. Specifically, as illustrated in FIG. 9, the image forming apparatus B includes a photosensitive drum 101 (first roller, image bearing member) and a transfer roller 105 (second roller), wherein a recording medium is nipped and conveyed by the photosensitive drum 101 and the transfer roller 105 and a toner image on the photosensitive drum 101 is transferred onto the recording medium. When the above-mentioned configuration is applied to the configuration in which the transfer roller 105 is switched between the restraint state and the release state with the opening-closing of the door 16, the effect similar to the above-mentioned effect can be obtained.

In addition, while the present embodiment shows an image forming apparatus as an apparatus provided with a sheet conveying apparatus for describing the present invention, the present invention is not limited thereto. Specifically, the present invention is applicable to an apparatus provided with a mechanism for nipping and conveying a sheet. For example, the present invention is applicable to an image reading apparatus provided with an image reading portion that reads an image of an original.

In addition, while the present embodiment describes, as one example, the transfer portion that transfers a toner image, the present invention is not limited thereto. Specifically, when the above-mentioned configuration is applied to a configuration including a first roller and a second roller, which make a pair, such as conveying rollers G1 to G3 in the present embodiment to convey a sheet while nipping the sheet by these rollers, the effect similar to the above-mentioned effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-115960 filed Jun. 10, 2016, NO. 2017-044610, filed Mar. 9, 2017, which are hereby incorporated by reference herein in their entirety.

What is claimed is:

1. A sheet conveying apparatus comprising:

a first roller that is provided to an apparatus body and rotates by receiving driving force from a drive source;

an opening-closing member that is provided to the apparatus body and is movable between an open position where a jam recovery of a sheet is enabled and a close position where sheet conveyance is performed;

a second roller that is provided to the opening-closing member, the second roller being urged toward the first roller to convey the sheet with the rotation of the first roller, when the opening-closing member is in the close position;

an urging member that is provided on the opening-closing member at a position between the second roller and the opening-closing member, the urging member applying a force to the second roller toward the first roller when the opening-closing member is in the close position;

a restraint member that is provided to the opening-closing member, the restraint member being brought into contact with a rotation shaft of the second roller and restraining the rotation shaft relative to the opening-closing member with the urging member being compressed when being moved, the restraint member switching between a restraint state in which the rotation shaft is restrained and a release state in which the rotation shaft is released from the restraint, by being moved, wherein, when the opening-closing member is in the close position and the rotation shaft is in the release state, the restraint member switches the rotation shaft to the restraint state from the release state during the movement of the opening-closing member from the close position to the open position, and keeps the rotation shaft in the restraint state until the opening-closing member reaches the open position, and during the movement of the opening-closing member from the open position to the close position, the restraint member keeps the rotation shaft in the restraint state; and a releasing member that is moved by driving force from the drive source when the opening-closing member is in the close position and the rotation shaft is in the restraint state, the releasing member switching the rotation shaft to the release state by moving the restraint member as being engaged with the restraint member.

2. The sheet conveying apparatus according to claim 1, wherein the second roller does not apply a force to the first roller by the urging member, when the opening-closing member is in the close position and the rotation shaft is in the restraint state.

3. The sheet conveying apparatus according to claim 1, wherein the restraint member is a cam member supported by the opening-closing member so as to be rotatable, the cam member switching the rotation shaft to the release state from the restraint state by being rotated by the releasing member in response to the driving force from the drive source.

4. The sheet conveying apparatus according to claim 3, wherein the cam member has a restraint portion that keeps the rotation shaft in the restraint state.

5. The sheet conveying apparatus according to claim 3, wherein the releasing member has a protrusion that rotates in synchronization with the rotation of the first roller, and wherein the cam member has a gear that is engaged with the protrusion and receives rotation force by the rotation of the protrusion.

6. An image forming apparatus comprising:

an image bearing member that carries a developer image to be transferred onto a sheet;

a first roller that is provided to an apparatus body and rotates by receiving driving force from a drive source;

an opening-closing member that is provided to the apparatus body and is movable between an open position where a jam recovery of a sheet is enabled and a close position where sheet conveyance is performed;

a second roller that is provided to the opening-closing member, the second roller being urged toward the first roller through the image bearing member to convey the sheet with the rotation of the first roller and to transfer the developer image on the image bearing member to the sheet, when the opening-closing member is in the close position;

an urging member that is provided on the opening-closing member at a position between the second roller and the opening-closing member, the urging member applying a force to the second roller toward the first roller when the opening-closing member is in the close position;

a restraint member that is provided to the opening-closing member, the restraint member being brought into contact with a rotation shaft of the second roller and restraining the rotation shaft relative to the opening-closing member with the urging member being compressed when being moved, the restraint member switching between a restraint state in which the rotation shaft is restrained and a release state in which the rotation shaft is released from the restraint, by being moved, wherein, when the opening-closing member is in the close position and the rotation shaft is in the release state, the restraint member switches the rotation shaft to the restraint state from the release state during the movement of the opening-closing member from the close position to the open position, and keeps the rotation shaft in the restraint state until the opening-closing member reaches the open position, and during the movement of the opening-closing member from the open position to the close position, the restraint member keeps the rotation shaft in the restraint state; and a releasing member that is moved by driving force from the drive source when the opening-closing member is in the close position and the rotation shaft is in the restraint state, the releasing member switching the rotation shaft to the release state by moving the restraint member as being engaged with the restraint member.

7. The image forming apparatus according to claim 6, wherein the second roller is a transfer roller that transfers the developer image carried on the image bearing member to the sheet.

8. The image forming apparatus according to claim 7, wherein the image bearing member is an intermediate transfer belt.

9. An image reading apparatus comprising:

an image reading portion that reads images on an original including a sheet;

a first roller that is provided to an apparatus body and rotates by receiving driving force from a drive source;

an opening-closing member that is provided to the apparatus body and is movable between an open position where a jam recovery of a sheet is enabled and a close position where sheet conveyance is performed;

a second roller that is provided to the opening-closing member, the second roller being urged toward the first roller to convey the sheet with the rotation of the first roller, when the opening-closing member is in the close position;

an urging member that is provided on the opening-closing member at a position between the second roller and the opening-closing member, the urging member applying a force to the second roller toward the first roller when the opening-closing member is in the close position;

a restraint member that is provided to the opening-closing member, the restraint member being brought into contact with a rotation shaft of the second roller and restraining the rotation shaft relative to the opening-closing member with the urging member being compressed when being moved, the restraint member switching between a restraint state in which the rotation shaft is restrained and a release state in which the rotation shaft is released from the restraint, by being moved, wherein, when the opening-closing member is in the close position and the rotation shaft is in the release state, the restraint member switches the rotation shaft to the restraint state from the release state during the movement of the opening-closing member from the close position to the open position, and keeps the rotation shaft in the restraint state until the opening-closing member reaches the open position, and during the movement of the opening-closing member from the open position to the close position, the restraint member keeps the rotation shaft in the restraint state; and a releasing member that is moved by driving force from the drive source when the opening-closing member is in the close position and the rotation shaft is in the restraint state, the releasing member switching the rotation shaft to the release state by moving the restraint member as being engaged with the restraint member.

10. A sheet conveying apparatus comprising:

a first roller, provided to an apparatus body, configured to convey the sheet and configured to rotate by receiving driving force from a drive source;

an opening-closing member, provided to the apparatus body, configured to be movable between an open position where a jam recovery of a sheet is enabled and a close position where sheet conveyance is performed;

a second roller, provided to the opening-closing member, configured to convey the sheet with the rotation of the first roller, the second roller being urged toward the first roller when the opening-closing member is in the close position;

an urging member, provided on the opening-closing member at a position between the second roller and the opening-closing member, configured to apply a force to the second roller toward the first roller when the opening-closing member is in the close position;

a separation member, provided to the opening-closing member, configured to be movable relative to the opening-closing member between a separate position and a contact position, wherein (a) in a case that a relative position of the separation member relative to the opening-closing member is the separate position and the opening-closing member is in the close position, the first roller and the second roller are separated, (b) in a case that the relative position of the separation member relative to the opening-closing member is the contact position and the opening-closing member is in the close position, the first roller and the second roller are contacted, and (c) in a case that the relative position of the separation member relative to the opening-closing member is the contact position and the opening-closing member is in the close position, the relative position of the separation member relative to the opening-closing member changes from the contact position to the separate position in conjunction with the movement of the opening-closing member from the close position to the open position; and a releasing member configured to be moved by driving force from the drive source to move the separation member in the separate position to the contact position as being engaged with the separation member when the opening-closing member is in the close position.

* * * * *